US010513017B2

(12) United States Patent
Lourenco et al.

(10) Patent No.: US 10,513,017 B2
(45) Date of Patent: Dec. 24, 2019

(54) DRIVE GUIDE FOR FASTENING BITS

(71) Applicant: BLACK & DECKER INC., Newark, DE (US)

(72) Inventors: Marco Lourenco, Baltimore, MD (US); Michael P. Peters, Lutherville, MD (US)

(73) Assignee: BLACK & DECKER INC., New Britain, CT (US)

( * ) Notice: Subject to any disclaimer, the term of this patent is extended or adjusted under 35 U.S.C. 154(b) by 1063 days.

(21) Appl. No.: 14/811,873

(22) Filed: Jul. 29, 2015

(65) Prior Publication Data

US 2017/0028538 A1 Feb. 2, 2017

(51) Int. Cl.
*B25B 23/12* (2006.01)
*B25B 23/00* (2006.01)

(52) U.S. Cl.
CPC ..... *B25B 23/12* (2013.01); *B25B 23/005* (2013.01); *B25B 23/0035* (2013.01)

(58) Field of Classification Search
CPC ..... B25B 23/12; B25B 23/005
USPC ..... 81/451
See application file for complete search history.

(56) References Cited

U.S. PATENT DOCUMENTS 2,720,804 A 10/1955 Brown
3,392,767 A 7/1968 Stillwagon, Jr.
5,335,409 A * 8/1994 Elvebak ..... B25B 15/02 29/451
5,934,384 A 8/1999 Wang
6,006,630 A * 12/1999 Vasichek ..... B25B 23/12 81/125
RE36,797 E 8/2000 Eggert et al.
6,520,509 B1 * 2/2003 Vasudeva ..... B23B 31/1071 279/14
6,530,299 B1 3/2003 Liu
6,644,150 B2 11/2003 Chen
6,860,178 B2 3/2005 Wang
RE38,778 E 8/2005 Eggert et al.
7,096,768 B1 8/2006 Chen
7,469,909 B2 * 12/2008 Strauch ..... B25B 23/0035 279/75
7,481,136 B2 1/2009 Chiang
(Continued)

FOREIGN PATENT DOCUMENTS

EP 1955819 A1 8/2008

OTHER PUBLICATIONS

Pothmann, Johannes—Partial European Search Report re related application No. EP16181615—Jun. 7, 2017—7 pages—The Hague.

*Primary Examiner* — Hadi Shakeri
(74) *Attorney, Agent, or Firm* — Scott B. Markow

(57) ABSTRACT

A drive guide for driving a fastening bit includes a drive shaft, a socket shaft with a rear end non-rotationally coupled to the front end of the drive shaft and a front end with a socket that receives the fastening bit, and a sliding sleeve received over the socket shaft and slidable between a rear position and a forward position. A magnet is received in the socket with an air gap behind the magnet to magnetize a fastening bit received in the socket. An internal shoulder is integrally formed inside a rear end of the sliding sleeve. The internal shoulder abuts an external rear stop on one of the drive shaft and the socket shaft when the sliding sleeve is in the rear position and abuts a front external stop on the socket shaft when the sliding sleeve is in the forward position.

12 Claims, 13 Drawing Sheets

(56) References Cited

U.S. PATENT DOCUMENTS

| | | | |
|---|---|---|---|
| 7,654,175 | B2 | 2/2010 | Hamon |
| 7,669,860 | B2 | 3/2010 | Chiang |
| 7,913,592 | B2 | 3/2011 | Hu |
| 8,172,236 | B2 | 5/2012 | Shibata |
| 8,544,368 | B2 | 10/2013 | Su |
| 8,720,909 | B2 | 5/2014 | Hu |
| 8,864,143 | B2 | 10/2014 | Lin |
| 8,864,144 | B2 | 10/2014 | Hsu |
| 2007/0034060 | A1 * | 2/2007 | McCracken ..... B25B 23/0064 81/429 |
| 2007/0234856 | A1 | 10/2007 | Liu |
| 2009/0139379 | A1 | 6/2009 | Chiang et al. |
| 2011/0215538 | A1 | 9/2011 | Cornwell et al. |
| 2012/0272795 | A1 | 11/2012 | Chen |
| 2013/0221058 | A1 | 8/2013 | Neitzell et al. |
| 2013/0312577 | A1 | 11/2013 | Burrows et al. |
| 2014/0311302 | A1 | 10/2014 | Taguchi et al. |

* cited by examiner

DRIVE GUIDE FOR FASTENING BITS

TECHNICAL FIELD

This application relates to a drive guide for a fastening bit.

BACKGROUND

Drive guides are known to retain and drive fastening bits (such as screwdriving bits) using a power tool. As shown in FIGS. 16A-16D, in one prior art example, a DeWALT DW2055 Magnetic Drive Guide 10 comprises a drive shaft 12, a socket shaft 20, and a sliding sleeve 30. The drive shaft 12 has a hex-shaped rear shank portion 14 configured to be received in a driving end of an electric screwdriving tool, an intermediate shaft portion 15 with longitudinal grooves 18, and a round front shaft portion 16. The front shaft portion 16 is non-rotatably press fit in a bore (not shown) in a rear end 22 of the socket shaft 20. A hex shaped socket (not shown) for receiving a screwdriving bit 36 is formed in a front end 24 of the socket shaft. A magnet (not shown) may be received in the socket to retain and magnetize the screwdriving bit. Coupled to the socket shaft 30 are a rear hog ring 26 at the rear 22 end and a front hog ring 28 at the front end 24. The sliding sleeve 30 is received over the socket shaft 20. The sliding sleeve 30 is hollow and cylindrical with a V-shaped internal annular groove 32 at its rear end 34. The sleeve can slide between a rear position (FIG. 16A) where the rear hog ring 26 is received in the annular groove 32, and a front position (FIG. 16B) where the front hog ring is received in the annular groove. The drive shaft 12 is composed of mild steel, the socket shaft 20 is composed of aluminum, and the sliding sleeve 30 is composed of brass.

These prior art drive guides tend to fail frequently (e.g., approximately 50% of the time or more), especially when used with an impact driver. The usual points of failure are the rear hog ring becoming jammed in the V-shaped annular groove in the sliding sleeve and the socket in the front of the socket shaft fracturing or becoming worn. After use in an impact driver, the sliding sleeve can be difficult to slide between the rearward and forward positions and tends to get stuck in one of these positions. Finally, regardless of whether the drive guide is used in an impact driver, some of the magnetism from the magnet tends to magnetize the drive shaft, which reduces the magnetic field available to magnetize the fastening bit and in turn magnetically retain a fastener. It is desirable to have a drive guide with better performance with an impact driver.

SUMMARY

In an aspect, a drive guide for driving fastening bits includes a drive shaft extending along an axis. The shaft has a rear shank portion configured to be coupled to a power tool and a front shaft portion extending axially forward of the rear shank portion. A socket shaft composed of a non-paramagnetic material extends along the axis. The socket shaft has a rear end with a coupling that non-rotationally attaches the rear end to the front shaft portion of the drive shaft and a front end having a socket open to the front end. The socket is configured to receive a fastening bit. A magnet is received in the socket with an air gap behind the magnet. The magnet is configured to magnetize a fastening bit received in the socket. A generally cylindrical sliding sleeve composed of a non-paramagnetic material is received over the socket shaft and is slidable along the axis between a rear position in which a front end of the sliding sleeve is aligned with or is axially rearward of the front end of the socket shaft and a forward position in which the front end of the sliding sleeve is axially forward of the front end of the socket shaft.

Implementations of this aspect may include one or more of the following features. The front socket may include a front hex portion for receiving a hex shaped fastening bit and a rear counterbore that receives the magnet. An internal shoulder may be integrally formed inside a rear end of the sliding sleeve, the internal shoulder having a second internal diameter that is less than a first internal diameter of the sliding sleeve. An external front shoulder may be integrally formed on the front end of the socket shaft, the front shoulder configured to abut against the internal shoulder when the sliding sleeve is in the forward position to prevent removal of the sliding sleeve from the socket shaft in the axial forward direction. The internal shoulder is formed by swaging the rear end of the sliding sleeve. An external rear stop may be on one of the drive shaft and the socket shaft, the rear stop positioned to abut against the rear end of the sliding sleeve when the sliding sleeve is in the rear position. The rear stop nay include a removable clip and/or an external rear shoulder integrally formed on one of the drive shaft and the socket shaft. An O-ring may be disposed on the socket shaft to frictionally resist axial movement of the sliding sleeve relative to the socket shaft. The drive shaft may be composed of a paramagnetic material. The drive shaft may be composed of a carbon steel material, the socket shaft may be composed of a stainless steel material, and the sliding sleeve may be composed of one of a brass material, an aluminum material, and a stainless steel material.

In another aspect, a drive guide for driving fastening bits includes a drive shaft extending along an axis. The drive shaft has a rear shank portion configured to be coupled to a power tool and a front shaft portion extending axially forward of the rear shank portion. A socket shaft extends along the axis and has a rear end with a coupling that non-rotationally attaches the rear end to the front shaft portion of the drive shaft and a front end having a socket open to the front end. The socket is configured to receive a fastening bit. A magnet is received in the socket and is configured to magnetize a fastening bit received in the socket. A generally cylindrical sliding sleeve is received over the socket shaft and is slidable along the axis between a rear position in which a front end of the sliding sleeve is aligned with or is axially rearward of the front end of the socket shaft and a forward position in which the front end of the sliding sleeve is axially forward of the front end of the socket shaft. The sliding sleeve has a first internal diameter. An internal rear stop is integrally formed inside a rear end of the sliding sleeve. The internal rear stop has a second internal diameter that is less than the first internal diameter. An external rear stop is on one of the drive shaft and the socket shaft, the external rear stop positioned to abut against the internal rear stop of the sliding sleeve when the sliding sleeve is in the rear position. An external front shoulder is integrally formed on the front end of the socket shaft. The external front shoulder is configured to abut against the internal rear stop when the sliding sleeve is in the forward position to prevent removal of the sliding sleeve from the socket shaft in the axial forward direction.

Implementations of this aspect may include one or more of the following features. The internal shoulder may be formed by swaging the rear end of the sliding sleeve. The rear stop may include a removable clip and/or an external rear shoulder integrally formed on one of the drive shaft and the socket shaft. An O-ring may be disposed on the socket shaft to frictionally resist axial movement of the sliding sleeve relative to the socket shaft. The O-ring may be disposed on the front shoulder. The drive shaft may be formed of a paramagnetic material and the socket retainer and sleeve each may be formed of non-paramagnetic metal materials. The drive shaft may be composed of a carbon steel material, the socket shaft may be composed of a stainless steel material, and the sliding sleeve may be composed of one of a brass material, an aluminum material, and a stainless steel material.

In another aspect, a drive guide for driving fastening bits includes a drive shaft extending along an axis. The drive shaft has a rear shank portion configured to be coupled to a power tool and a front shaft portion extending axially forward of the rear shank portion. A socket shaft extends along the axis. The socket shaft has a rear end with a coupling that non-rotationally attaches the rear end to the front shaft portion of the drive shaft and a front end having a socket open to the front end. The socket is configured to receive a fastening bit. A magnet is received in the socket with an air gap behind the magnet and is configured to magnetize a fastening bit received in the socket. A generally cylindrical sliding sleeve is received over the socket shaft and is slidable along the axis between a rear position in which a front end of the sliding sleeve is aligned with or is axially rearward of the front end of the socket shaft and a forward position in which the front end of the sliding sleeve is axially forward of the front end of the socket shaft. The sliding sleeve has a first internal diameter. An internal shoulder is integrally formed inside a rear end of the sliding sleeve. The internal shoulder has a second internal diameter that is less than the first internal diameter. An external rear stop is on one of the drive shaft and the socket shaft, and is positioned to abut against the rear end of the sliding sleeve when the sliding sleeve is in the rear position. An external front shoulder is integrally formed on the front end of the socket shaft, and is configured to abut against the internal shoulder when the sliding sleeve is in the forward position to prevent removal of the sliding sleeve from the socket shaft in the axial forward direction. An O-ring is disposed on the socket shaft to frictionally resist axial movement of the sliding sleeve relative to the socket shaft. The drive shaft is composed of a paramagnetic material and the socket shaft and the sliding sleeve are each composed of a non-paramagnetic material. In one implementation of this aspect, the drive shaft may be composed of a carbon steel material, the socket shaft may be composed of a stainless steel material, and the sliding sleeve may be composed of one of a brass material, an aluminum material, and a stainless steel material.

Advantages may include one or more of the following. The drive guides have significantly improved life and durability when being used with an impact driver. In addition, the drive guides are better at magnetizing fastening bits in order to magnetically couple to a fastener. These and other advantages and features will be apparent from the description, the drawings, and the claims.

DETAILED DESCRIPTION

Figure 1A:
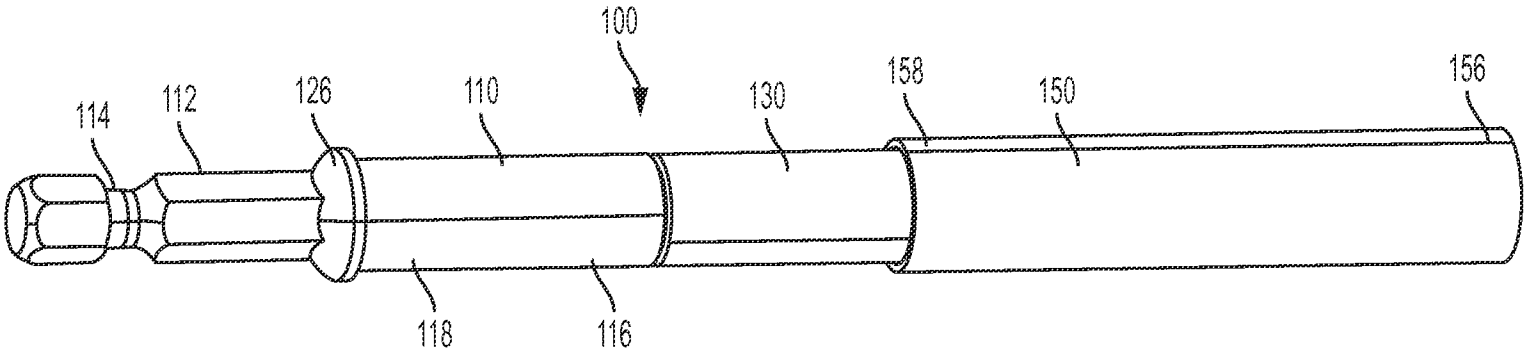
FIG. 1A is a perspective view of a first embodiment of a drive guide with the sliding sleeve in a forward position.
Figure 1B:
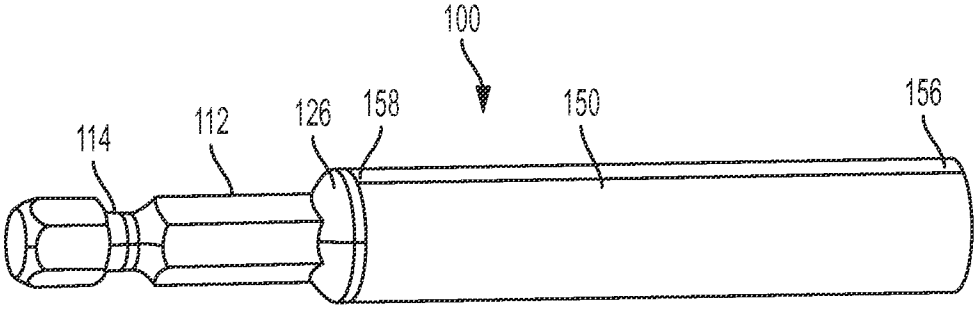
FIG. 1B is a perspective view of the drive guide of FIG. 1A with the sliding sleeve in a rearward position.
Figure 2:
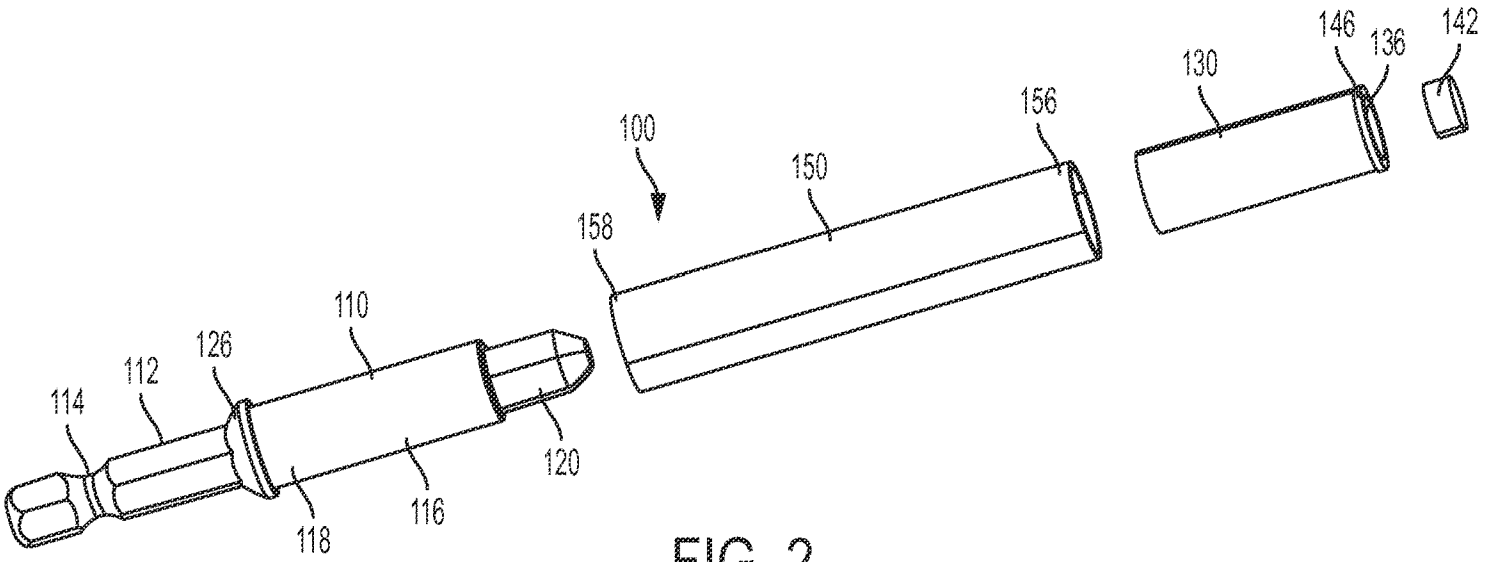
FIG. 2 is an exploded perspective view of the drive guide of FIG. 1A.
Figure 3:
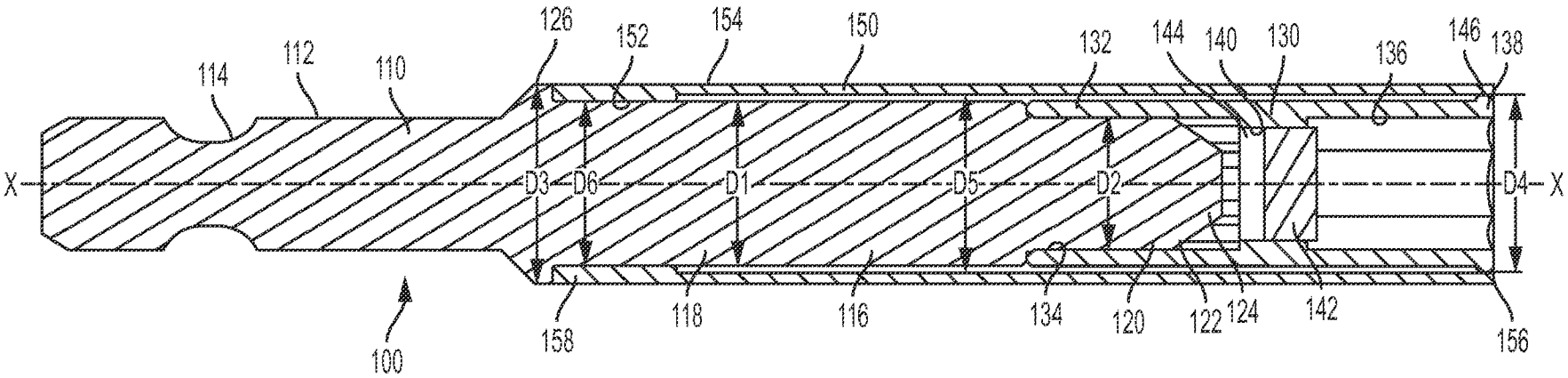
FIG. 3 is an assembled cross-sectional view of the drive guide of FIG. 1A.

Referring to FIGS. 1A-4, in a first embodiment, a drive guide 100 for driving fastening bits includes a drive shaft 110, a socket shaft 130, and a generally cylindrical sliding sleeve 150. The drive shaft 110 extends along an axis X and has a hex-shaped rear shank portion 112 with an annular groove 114 configured to be coupled to a power tool and a front shaft portion 116 extending axially forward of the rear shank portion 114 and configured to be non-rotatably coupled to the socket shaft 130. The front shaft portion 116 includes a round intermediate shaft 118 having a first diameter D1 and a front projection 120 of polygonal cross-section with a second diameter D2 (measured either across the flats or across the corners) that is smaller than the first diameter D1. The front projection 120 includes a tapered nose 122 at a front end 124. A rear external stop in the form of a rear external shoulder 126 is formed at a junction between the rear shank portion 114 and the front shaft portion 116. The rear external shoulder 126 has a third diameter D3 that is greater than both the first and second diameters D1 and D2.

The socket shaft 130 extends along the axis X and has a rear end 132 with a coupling in the form of a bore 134 with a circular or polygonal cross-section. The front projection 120 is press-fit into the bore 134 to non-rotationally couple the drive shaft 110 to the socket shaft 130. The socket shaft 130 also has front end 138 with a hex shaped socket 136 that is configured to receive a fastening bit (e.g., a screwdriving bit, not shown). At the base of the socket 136 is a round counterbore 140 that receives a magnet 142 in a press-fit manner. The magnet 142 fits into the counterbore 140 so that a portion of the magnet extends into the socket 136 and so that there is an air gap 144 behind the magnet 142 between the magnet 142 and the front end 124 of the drive shaft 110. This enables the magnet 142 to magnetize a fastening bit received in the socket 136, which in turn magnetically couples to a fastener to be driven, without significantly magnetizing the drive shaft 110. A front external stop in the form of an external front shoulder 146 is formed at the front end 138 of the socket shaft 130. The front shoulder 146 has a fourth diameter D4 that is greater than the second diameter D2 and less than or equal to the third diameter D3.

The generally cylindrical sliding sleeve 150 extends along the axis X and has a front end 156 and a rear end 158. The sliding sleeve 150 includes a rear internal stop in the form of a rear internal shoulder 152 formed on an internal wall 154 of the sliding sleeve 150. The sleeve 150 is received over the drive shaft 110 and the socket shaft 130 so that it is slidable along the axis X between a rear position (FIG. 1B) in which the internal shoulder 152 abuts the rear external shoulder 126 and a forward position (FIG. 1A) in which the internal shoulder 152 abuts the front external shoulder 146. In the rear position, the front end 156 of the sliding sleeve 150 is aligned with or is axially rearward of the front end 138 of the socket shaft 130. In the forward position, the front end 156 of the sliding sleeve 150 is axially forward of the front end 138 of the socket shaft 130. The sliding sleeve has a fifth internal diameter D5 that is slightly greater than the fourth diameter D4 of the front external shoulder 146 of the socket shaft 130, except for the rear internal shoulder 152, which has a sixth diameter D6 that is slightly greater than the first diameter D1 of the intermediate portion 118 of the drive shaft 110.

Figure 4:
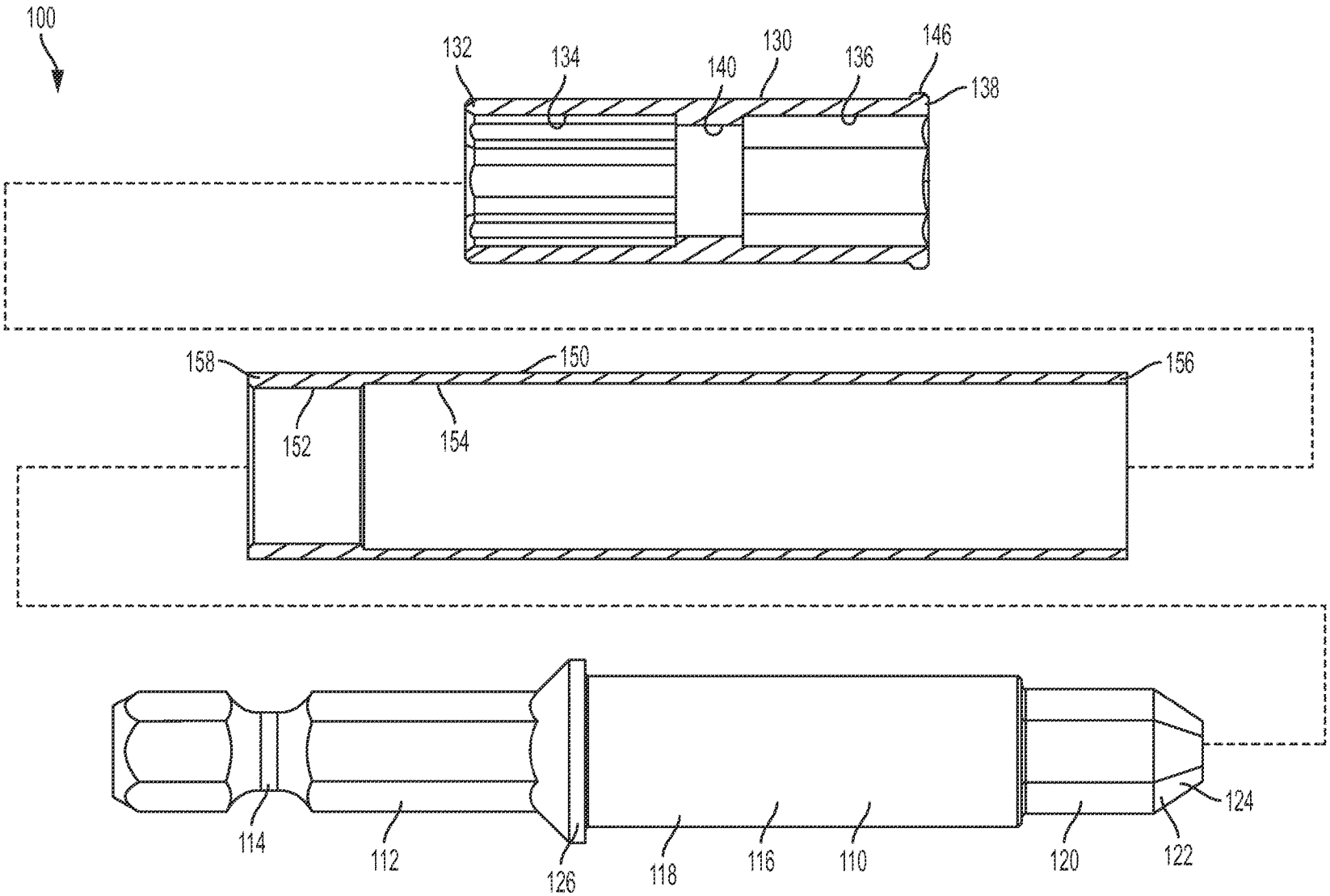
FIG. 4 is an exploded cross-sectional view of the drive guide of FIG. 1A.
Figure 5A:
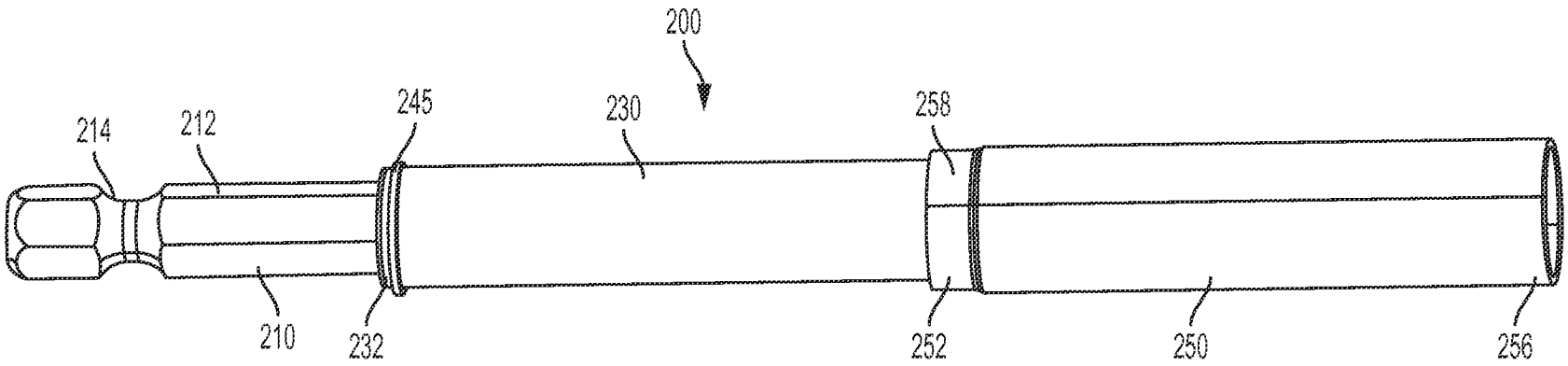
FIG. 5A is a perspective view of a second embodiment of a drive guide with the sliding sleeve in a forward position.
Figure 5B:
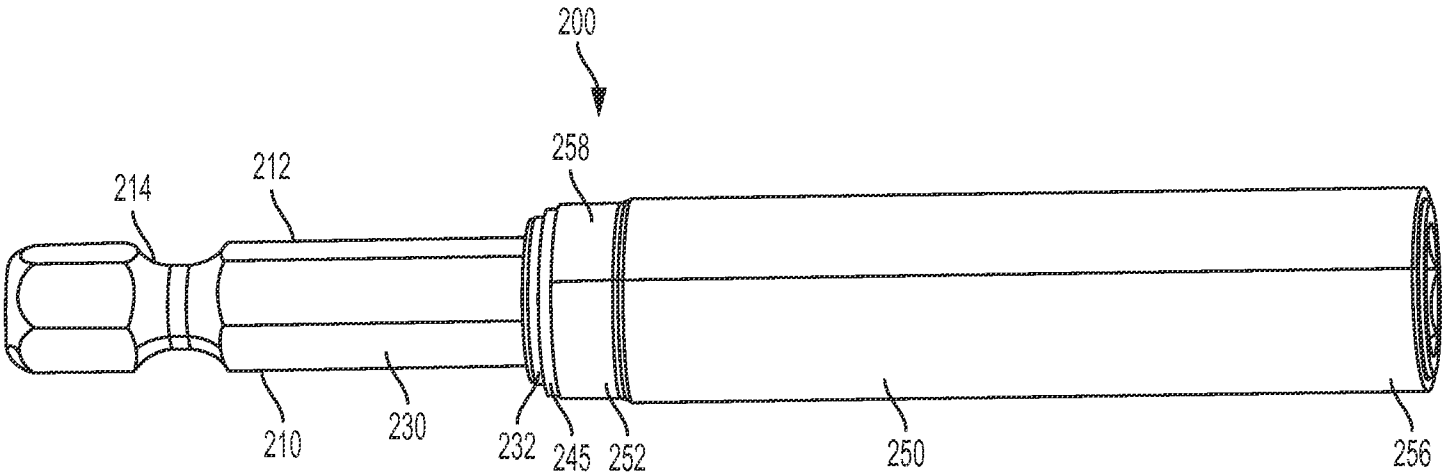
FIG. 5B is a perspective view of the drive guide of FIG. 5A with the sliding sleeve in a rearward position.
Figure 6:
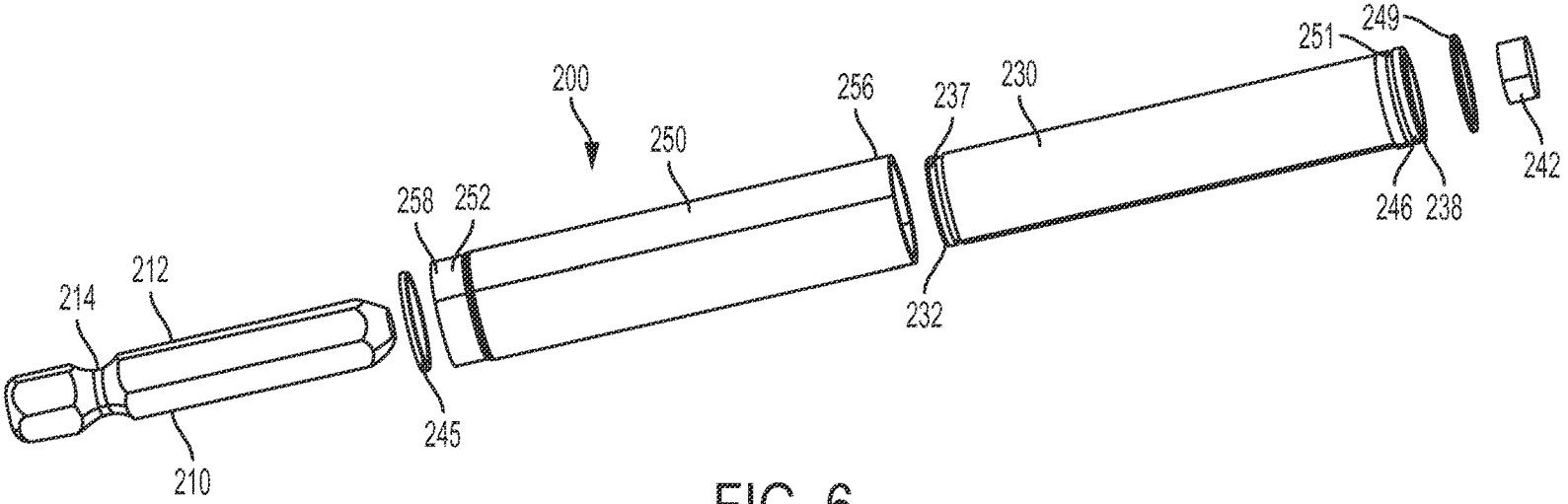
FIG. 6 is an exploded perspective view of the drive guide of FIG. 5A.
Figure 7:
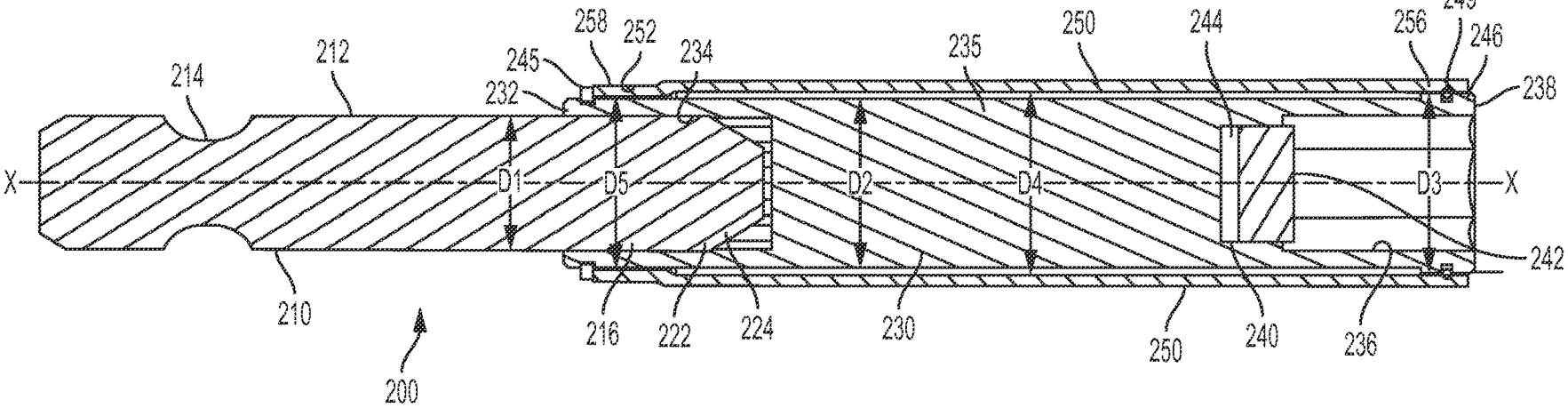
FIG. 7 is an assembled cross-sectional view of the drive guide of FIG. 5A.

As shown in FIG. 4, to assemble the drive guide 100, the rear end 158 of the sliding sleeve 150 is slid over the front shaft portion 116 of the drive shaft 110 until the internal shoulder 152 of the sliding sleeve 150 abuts the rear external shoulder 126 of the drive shaft 110. Next, the socket shaft 130 is inserted through the front end 156 of the sliding sleeve 150 and the front projection 120 of the drive shaft 110 is press fit into the rear bore 134 in the socket shaft 130. Finally, the magnet 142 is press fit into the counterbore 140 in the socket 136, leaving an air gap 144 between the magnet 142 and the drive shaft 110. The sliding sleeve 150 may now slide between its rearward position (FIG. 1B) where the internal shoulder 152 of the sliding sleeve 150 abuts the rear external shoulder 126 of the drive shaft 110 and its forward position (FIG. 1A) where the internal shoulder 152 of the sliding sleeve 150 abuts the front external shoulder 146 of the socket shaft 130.

Referring to FIGS. 5A-8, in a second embodiment, a drive guide 200 for driving fastening bits includes a drive shaft 210, a socket shaft 230, and a generally cylindrical sliding sleeve 250. The drive shaft 210 extends along an axis X and has a hex-shaped rear shank portion 212 with an annular groove 214 configured to be coupled to a power tool and a front polygonal (e.g., hex shaped) shaft portion 216 extending axially forward of the rear shank portion 214 and configured to be non-rotatably coupled to the socket shaft 230. The front shaft portion 216 has a first diameter D1 (measured either across the flats or across the corners) and a tapered nose 222 at a front end 224.

The socket shaft 230 is generally cylindrical with a second diameter D2 (which is greater than the first diameter D1) and extends along the axis X. The socket shaft 230 has a rear end 232 with a coupling in the form of a bore 234 with a non-circular (e.g., hex shaped) cross-section. The front portion 216 of the drive shaft 210 is press-fit into the bore 234 to non-rotationally couple the drive shaft 210 to the socket shaft 230. The socket shaft 230 also has an intermediate shaft portion 235 and a front end 238 with a hex shaped socket 236 that is configured to receive a fastening bit (e.g., a screwdriving bit, not shown). At the base of the socket 236 is a round counterbore 240 that receives a magnet 242 in a press-fit manner. The magnet 242 fits into the counterbore 240 so that a portion of the magnet extends into the socket 236 and so that there is an air gap 244 behind the magnet 242. This enables the magnet 242 to magnetize a fastening bit received in the socket 236 so that the fastening bit can magnetically couple to a fastener to be driven, without significantly magnetizing the drive shaft 210. A front external stop in the form of an external front shoulder 246 is formed at the front end 238 of the socket shaft 230. The front shoulder 246 has a third diameter D3 that is greater than the second diameter D2. The front shoulder 246 also has an annular groove 251 that receives an elastomeric O-ring 249 to frictionally resist (but not stop) movement of the sliding sleeve 250 relative to the socket shaft 230. Received in the rear end 232 of the socket shaft 230 is rear external stop in the form of a C-clip or hog ring 245 that has an outer diameter when installed that is approximately greater than or equal to the third diameter D3.

The generally cylindrical sliding sleeve 250 extends along the axis X and has a front end 256 and a rear end 258. The sliding sleeve 250 includes a rear internal stop in the form of a rear internal shoulder 252 that is formed by swaging or crimping the rear end 258 of the sliding sleeve 250. The sleeve 250 is received over the drive shaft 210 and the socket shaft 230 so that it is slidable along the axis X between a rear position (FIG. 5B) in which the internal shoulder 252 abuts the rear C-clip or hog ring 245 and a forward position (FIG. 5A) in which the internal shoulder 252 abuts the front external shoulder 246. In the rear position, the front end 256 of the sliding sleeve 250 is aligned with or is axially rearward of the front end 238 of the socket shaft 230. In the forward position, the front end 256 of the sliding sleeve 250 is axially forward of the front end 238 of the socket shaft 230. The sliding sleeve has a fourth internal diameter D4 that is slightly greater than the third diameter D3 of the front external shoulder 246 of the socket shaft 230, except for the rear internal shoulder 252, which has a fifth diameter D5 that is less than the third diameter D3 and slightly greater than the second diameter D2 of the socket shaft 230.

Figure 8:
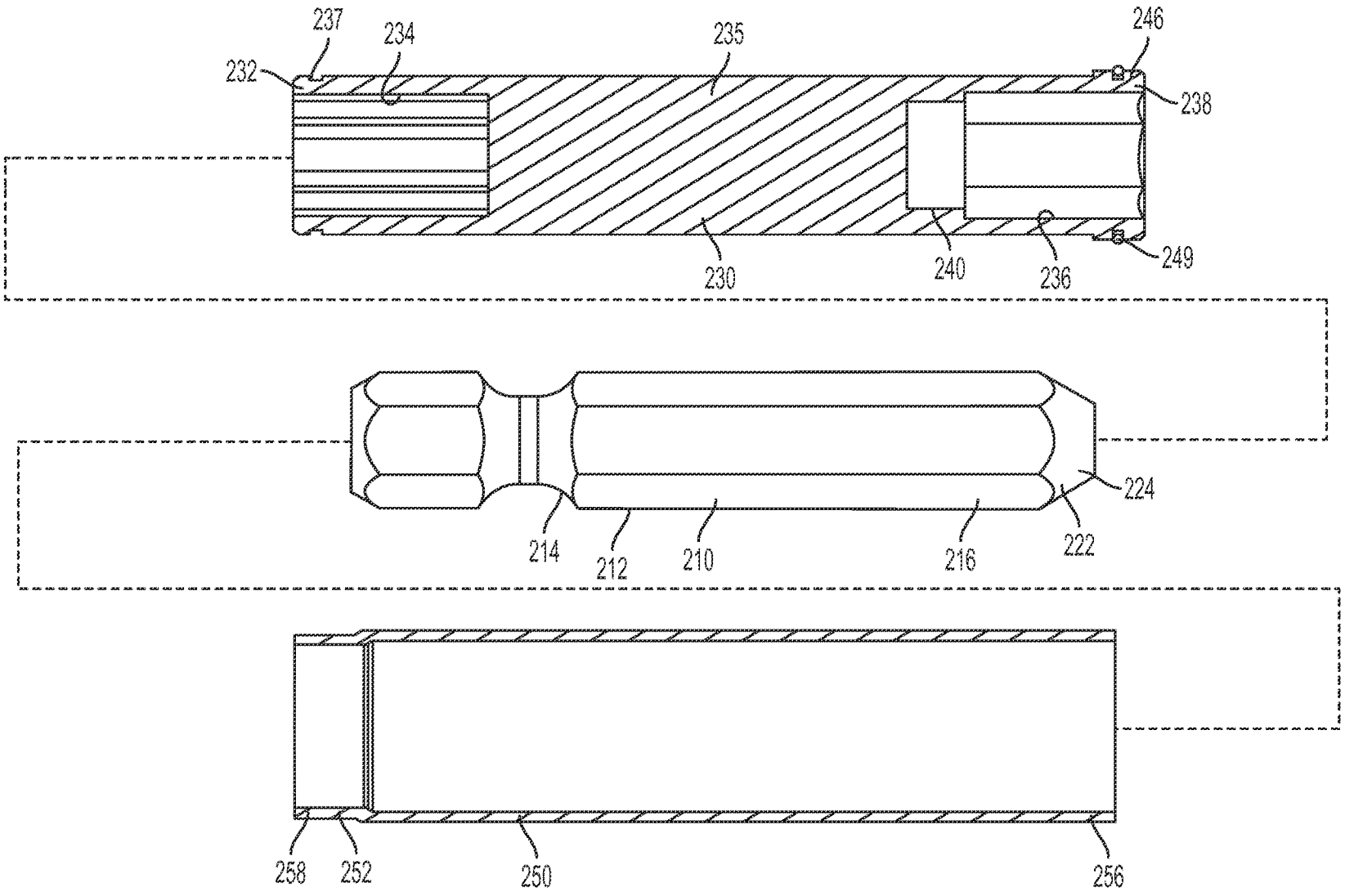
FIG. 8 is an exploded cross-sectional view of the drive guide of FIG. 5A.
Figure 9A:
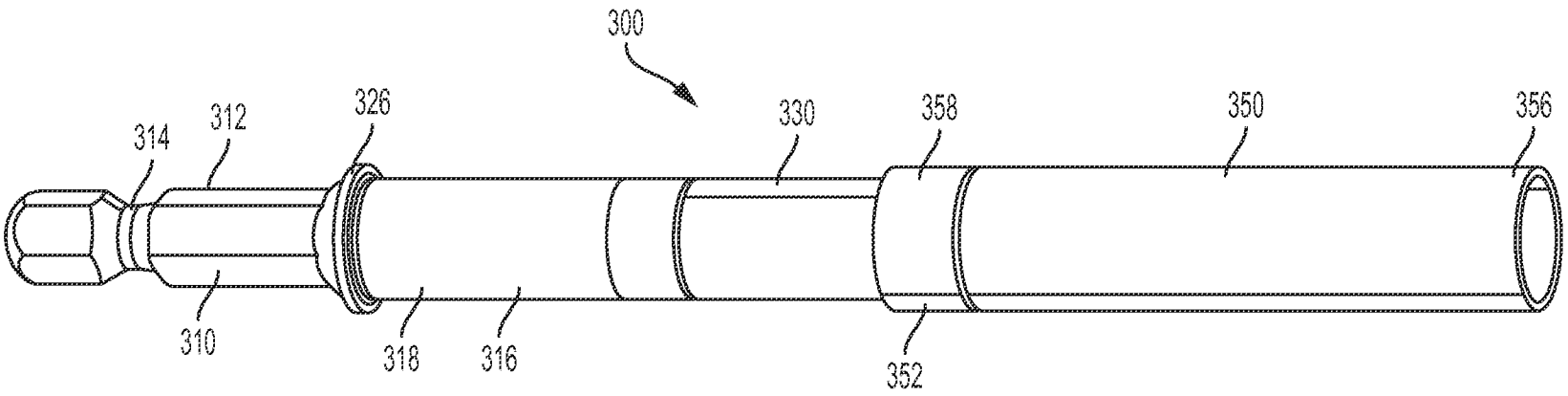
FIG. 9A is a perspective view of a third embodiment of a drive guide with the sliding sleeve in a forward position.
Figure 9B:
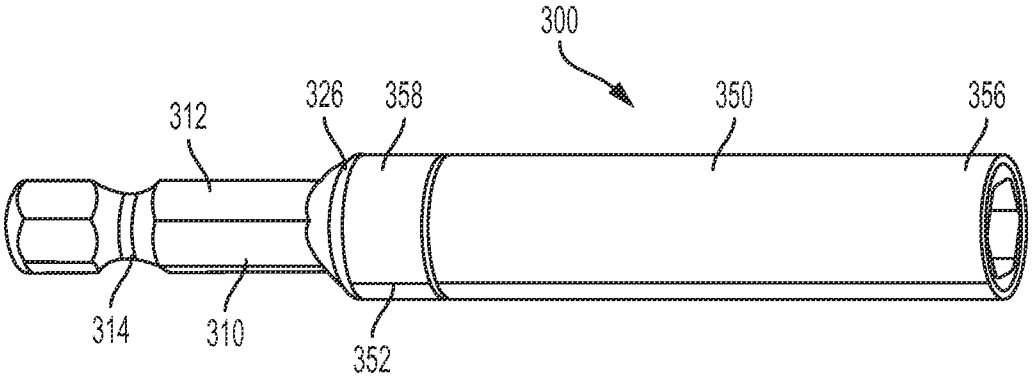
FIG. 9B is a perspective view of the drive guide of FIG. 9A with the sliding sleeve in a rearward position.
Figure 10:
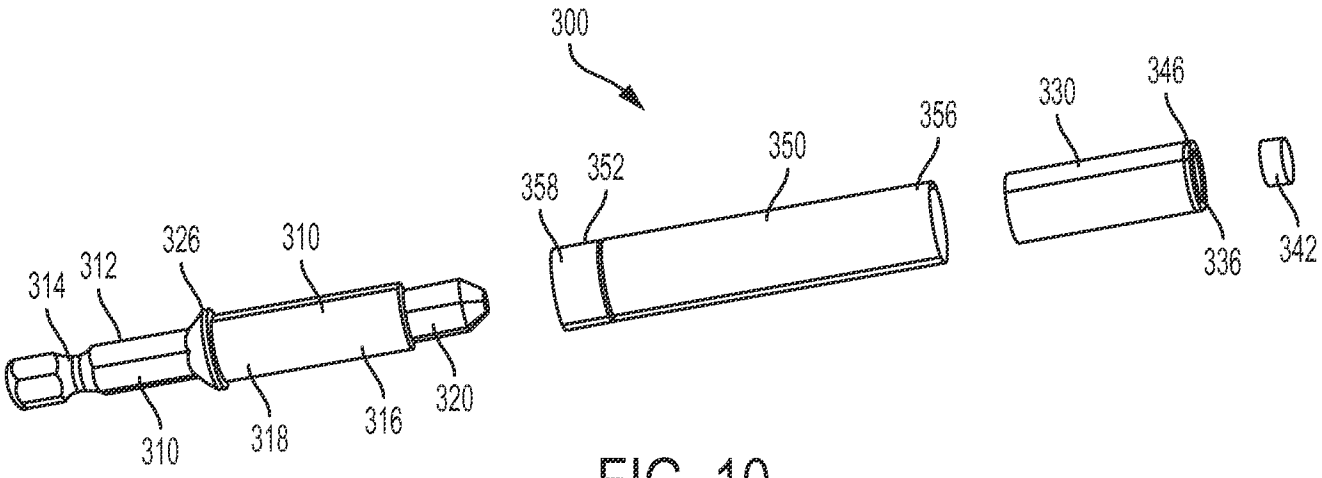
FIG. 10 is an exploded perspective view of the drive guide of FIG. 9A.
Figure 11:
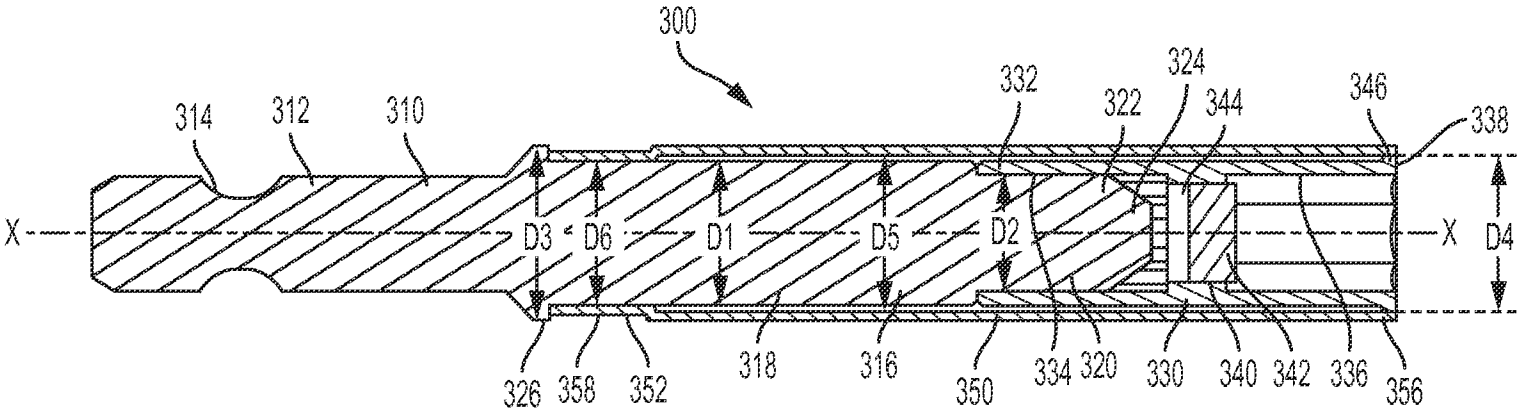
FIG. 11 is an assembled cross-sectional view of the drive guide of FIG. 9A.
Figure 12A:
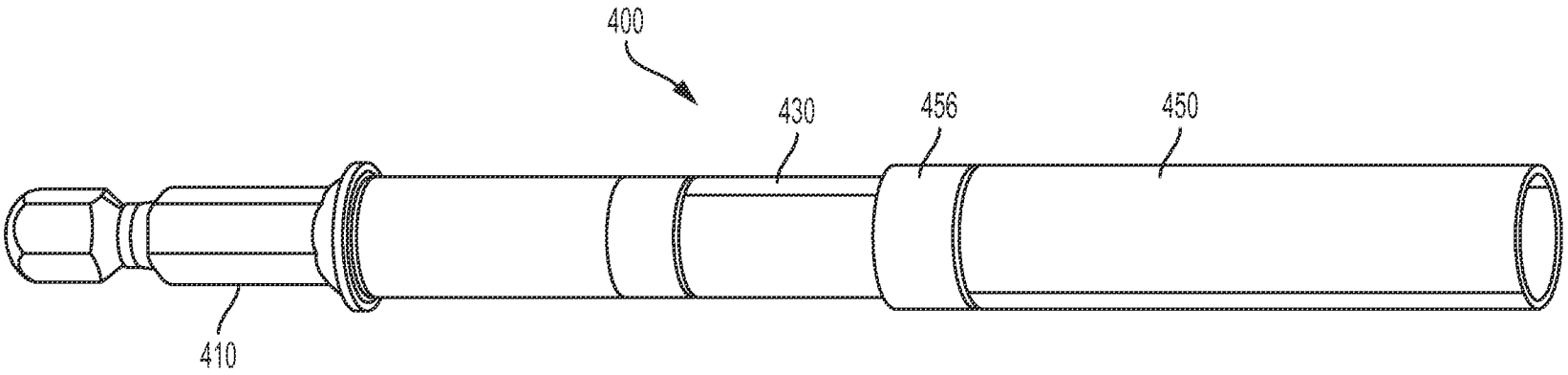
FIG. 12A is a perspective view of a fourth embodiment of a drive guide with the sliding sleeve in a forward position.
Figure 12B:
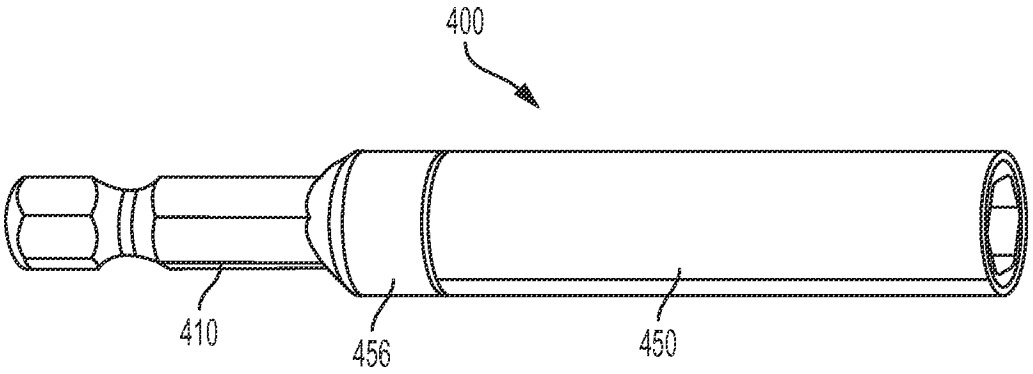
FIG. 12B is a perspective view of the drive guide of FIG. 12A with the sliding sleeve in a rearward position.
Figure 13:
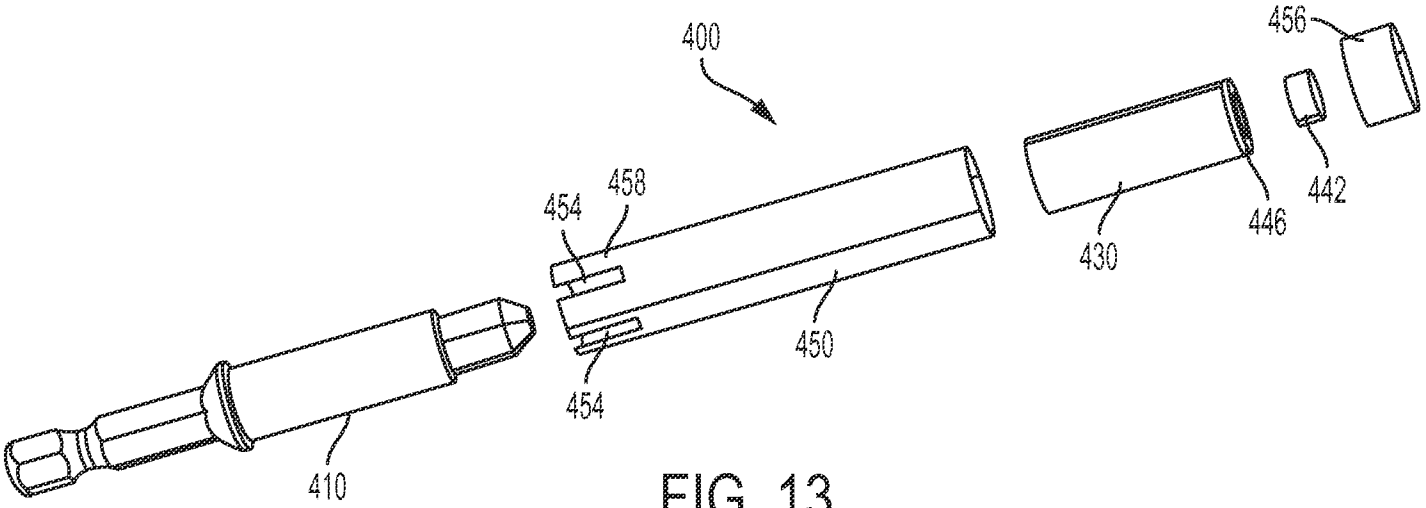
FIG. 13 is an exploded perspective view of the drive guide of FIG. 12A.
Figure 14:
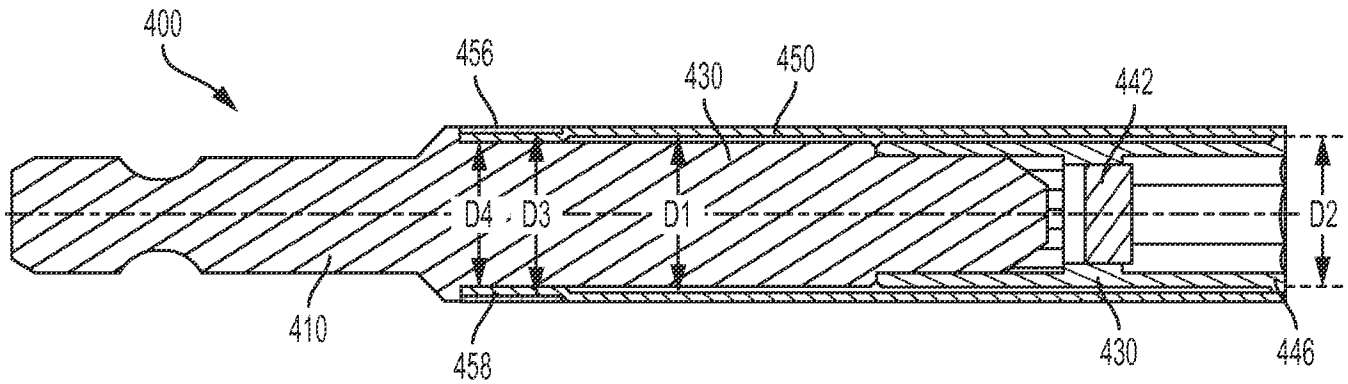
FIG. 14 is an assembled cross-sectional view of the drive guide of FIG. 12A.

As shown in FIG. 8, to assemble the drive guide 200, the front portion 216 of the drive shaft 210 is press fit into the rear bore 234 in the socket shaft 230. Next, the magnet 242 is press fit into the counterbore 240 in the socket 236, leaving an air gap 244 behind the magnet 242. The O-ring 249 is next coupled to the annular groove in the front shoulder 246 of the socket shaft 230. The front end 258 of the sliding sleeve 250 is then slid over the rear shank portion 212 of the drive shaft 210 until the internal shoulder 252 of the sliding sleeve 250 abuts the front external shoulder 246 of the socket sleeve 230. Next, the C-clip or hog ring 245 is coupled to an annular groove 237 in the rear end 232 of the socket sleeve 230 to act as a rear external stop. The sliding sleeve 250 may now slide between its rearward position (FIG. 5B) where the internal shoulder 252 of the sliding sleeve 250 abuts the rear C-clip or hog ring 245 on the socket shaft 230 and its forward position (FIG. 5A) where the internal shoulder 252 of the sliding sleeve 250 abuts the front external shoulder 246 of the socket shaft 230.

Referring to FIGS. 9A-11, in a third embodiment, a drive guide 300 for driving fastening bits includes a drive shaft 310, a socket shaft 330, and a generally cylindrical sliding sleeve 350. The drive shaft 310 extends along an axis X and has a hex-shaped rear shank portion 312 with an annular groove 314 configured to be coupled to a power tool and a front shaft portion 316 extending axially forward of the rear shank portion 314 and configured to be non-rotatably coupled to the socket shaft 330. The front shaft portion 316 includes a round intermediate shaft 318 having a first diameter D1 and a front projection 320 of polygonal (e.g., hex shaped) cross section with a second diameter D2 (measured either across the flats or across the corners) that is smaller than the first diameter D1. The front projection 320 includes a tapered nose 322 at a front end 324. A rear external stop in the form of a rear external shoulder 326 is formed at a junction between the rear shank portion 314 and the front shaft portion 316. The rear external shoulder 326 has a third diameter D3 that is greater than both the first and second diameters D1 and D2.

The socket shaft 330 extends along the axis X and has a rear end 332 with a coupling in the form of a bore 334 with a non-circular (e.g., hex shaped) cross-section. The front projection 320 is press-fit into the bore 334 to non-rotationally couple the drive shaft 310 to the socket shaft 330. The socket shaft 330 also has front end 338 with a hex shaped socket 336 that is configured to receive a fastening bit (e.g., a screwdriving bit, not shown). At the base of the socket 336 is a round counterbore 340 that receives a magnet 342 in a press-fit manner. The magnet 342 fits into the counterbore 340 so that a portion of the magnet extends into the socket 336 and so that there is an air gap 344 behind the magnet 342 and between the magnet 342 and the front end 324 of the drive shaft 310. This enables the magnet 342 to magnetize a fastening bit received in the socket 336 so that the fastening bit can magnetically couple to a fastener to be driven without significantly magnetizing the drive shaft 310. A front external stop in the form of an external front shoulder 346 is formed at the front end 338 of the socket shaft 330. The front shoulder 346 has a fourth diameter D4 that is greater than the second diameter D2 and less than or equal to the third diameter D3.

The generally cylindrical sliding sleeve 350 extends along the axis X and has a front end 356 and a rear end 358. The sliding sleeve 350 includes a rear internal stop in the form of a rear internal shoulder 352 that is formed by swaging or crimping the rear end 358 of the sliding sleeve 350. The sleeve 350 is received over the drive shaft 310 and the socket shaft 330 so that it is slidable along the axis X between a rear position (FIG. 9B) in which the internal shoulder 352 abuts the rear external shoulder 326 on the drive shaft 310 and a forward position (FIG. 5A) in which the internal shoulder 352 abuts the front external shoulder 346 on the socket shaft 330. In the rear position, the front end 356 of the sliding sleeve 350 is aligned with or is axially rearward of the front end 338 of the socket shaft 330. In the forward position, the front end 356 of the sliding sleeve 350 is axially forward of the front end 338 of the socket shaft 330. The sliding sleeve has a fifth internal diameter D5 that is slightly greater than the fourth diameter D4 of the front external shoulder 346 of the socket shaft 330, except for the rear internal shoulder 352, which has a sixth internal diameter D6 that is less than the fifth diameter D5 and slightly greater than the first diameter D1 of the drive shaft 310.

To assemble the drive guide 300, the rear end 358 of the sliding sleeve 350 is slid over the front shaft portion 316 of the drive shaft 310 until the internal shoulder 352 of the sliding sleeve 350 abuts the rear external shoulder 326 of the drive shaft 310. Next, the socket shaft 330 is inserted through the front end 356 of the sliding sleeve 350 and the front projection 320 of the drive shaft 310 is press fit into the rear bore 334 in the socket shaft 330. Finally, the magnet 342 is press fit into the counterbore 340 in the socket 336, leaving an air gap 344 behind the magnet 342 and between the magnet 342 and the drive shaft 310. The sliding sleeve 350 may now slide between its rearward position (FIG. 9B) where the internal shoulder 352 of the sliding sleeve 350 abuts the rear external shoulder 326 of the drive shaft 310 and its forward position (FIG. 9A) where the internal shoulder 352 of the sliding sleeve 350 abuts the front external shoulder 346 of the socket shaft 330.

Referring to FIGS. 12A-14, in a fourth embodiment, a drive guide 400 for driving fastening bits includes a drive shaft 410, a socket shaft 430, and a generally cylindrical sliding sleeve 450 that are similar to the drive shaft 310, the socket shaft 330, and the sliding sleeve 350 of the third embodiment. The drive guide 400 of the fourth embodiment differs from the drive guide 300 of the third embodiment in the way that a rear stop in the form of a rear internal shoulder 452 is formed in a rear end 458 of the sliding sleeve 450. The sliding sleeve 450 has a first internal diameter D1 that is slightly greater than a second external diameter D2 of a front external shoulder 446 on the socket shaft 430. The rear end 458 of the sliding sleeve 450 is formed with a plurality of axial slots 454. A retaining ring 456 is received over the slotted rear end 458 of the sliding sleeve 450. The retaining ring 456 has an third internal diameter D3 that may be less than the first internal diameter D1 of the sliding sleeve 450. The retaining ring 456 compresses the slotted rear end 458 of the sliding sleeve 450 to a fourth internal diameter D4 that is smaller than the first internal diameter D1 to form the internal shoulder. In one embodiment, the outer diameter of the retaining ring 456 may be the same as the outer diameter of the sliding sleeve. The other features of the drive guide 400, including the method of assembly, are the same as the drive guide 300 of the third embodiment.

Figure 15:
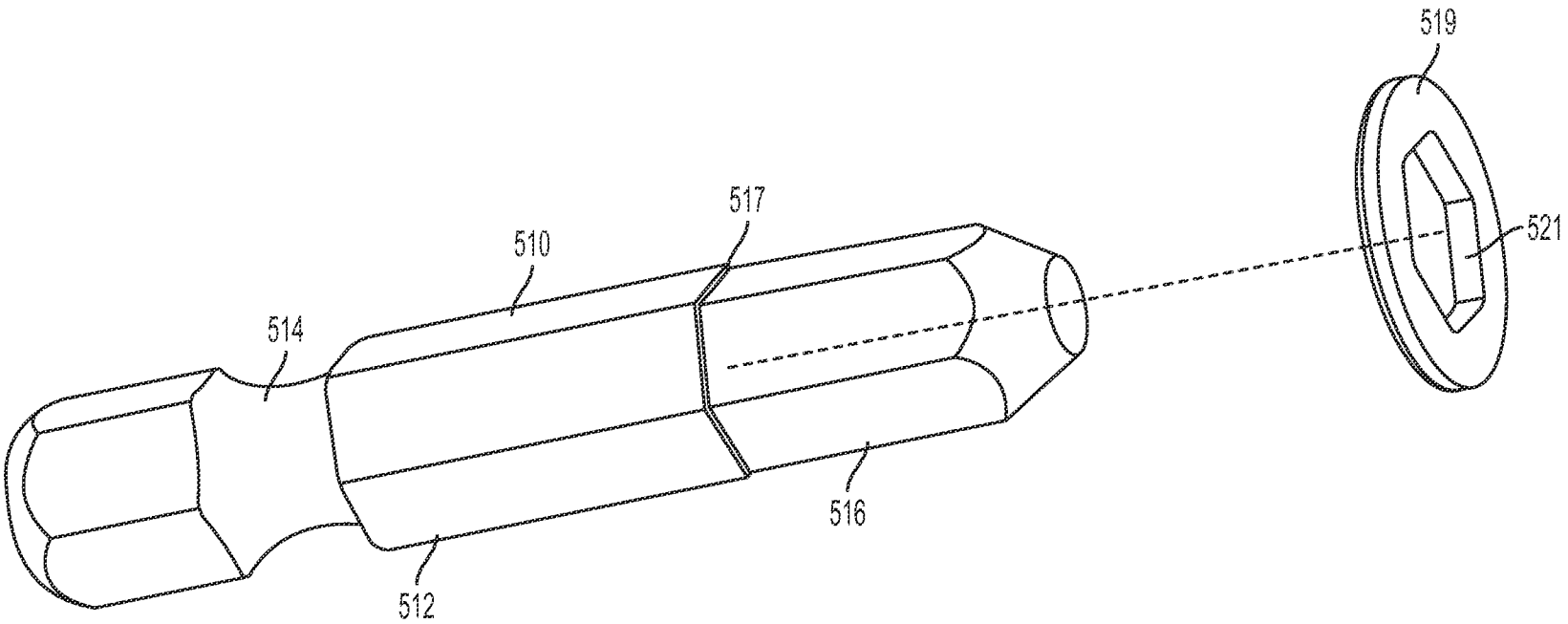
FIG. 15 is a perspective view of another embodiment of a drive shaft for use with the drive guides of FIGS. 1A, 5A, 9A, and 12A.
Figure 16A:
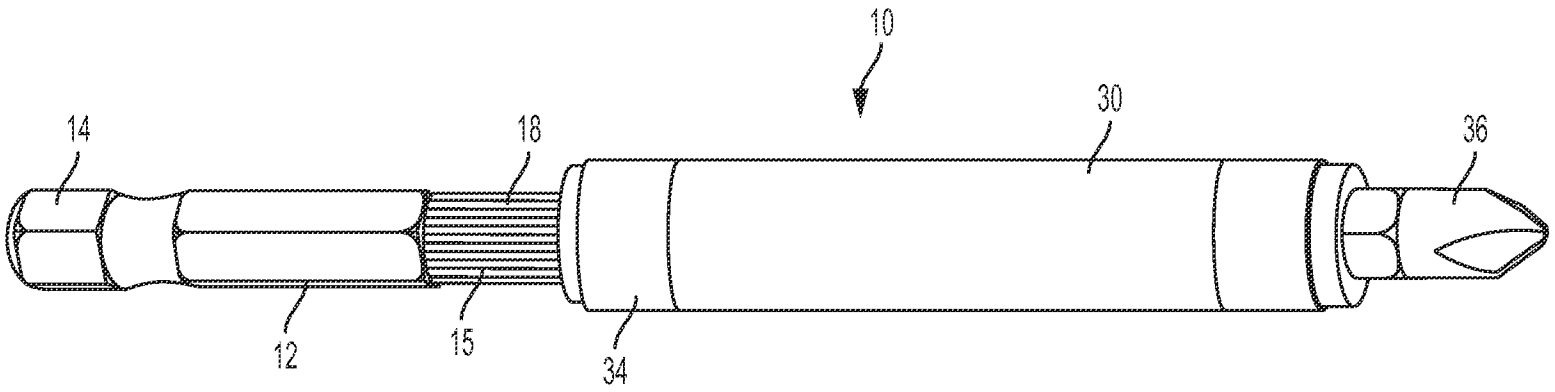
FIG. 16A PRIOR ART
FIG. 16A is a perspective view of a prior art design of a drive guide with the sliding sleeve in a forward position.
Figure 16B:
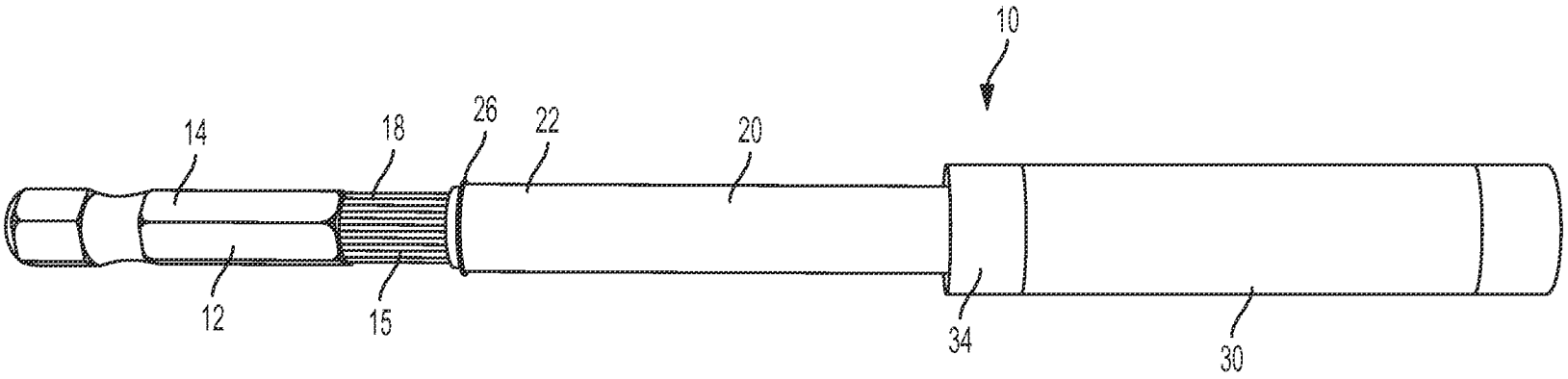
FIG. 16B PRIOR ART
FIG. 16B is a perspective view of the drive guide of FIG. 16A with the sliding sleeve in a rearward position.
Figure 16C:
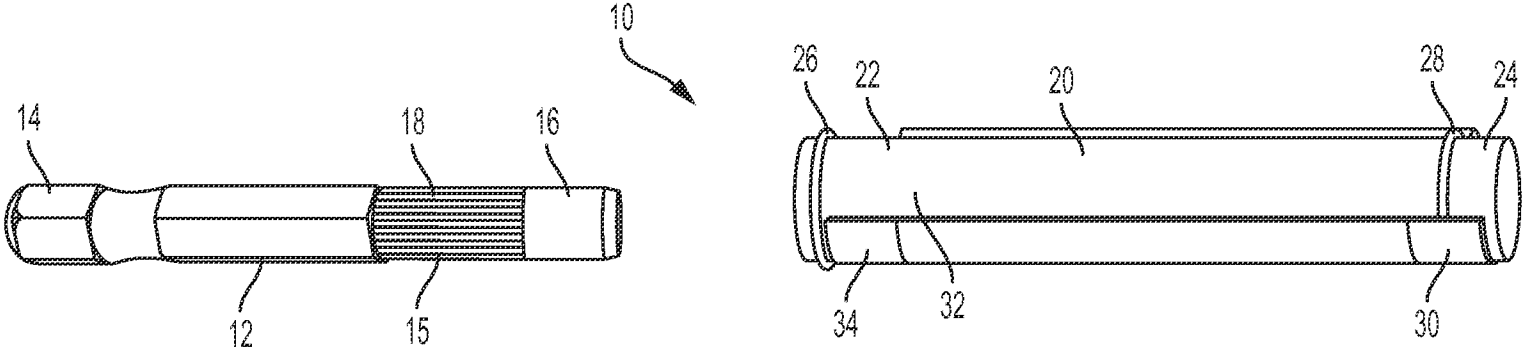
FIG. 16C PRIOR ART
FIG. 16C is a partially exploded perspective view of the drive guide of FIG. 16A.
Figure 16D:
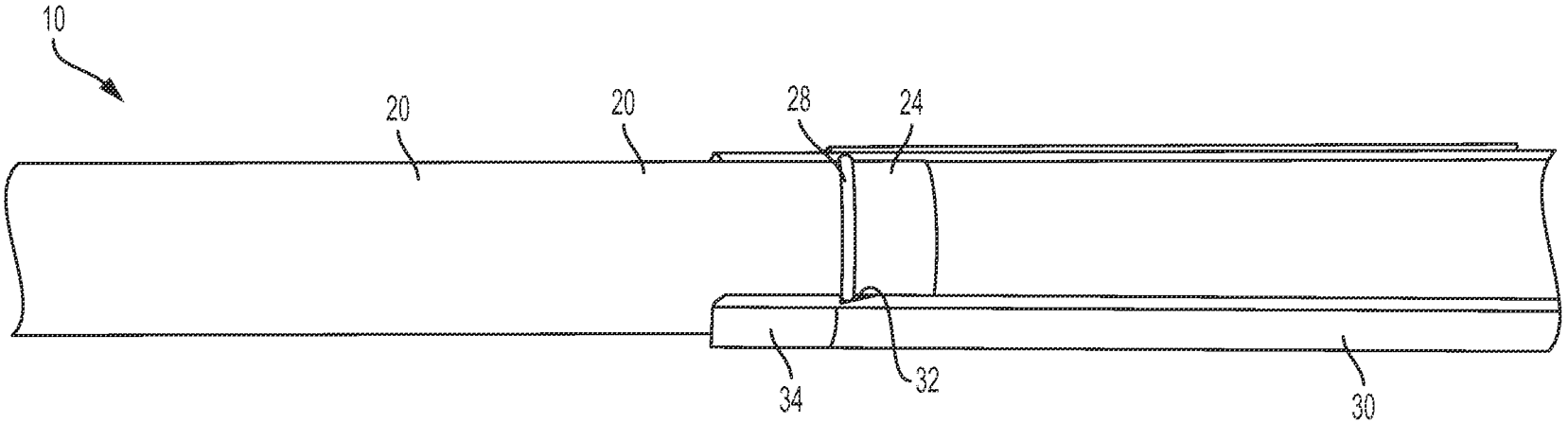
FIG. 16D PRIOR ART
FIG. 16D close-up perspective view of a portion of the drive guide of FIG. 16A.

Referring to FIG. 15, in another embodiment, a drive shaft 500 may be substituted for one of the drive shafts 110, 210, 310, and 410 of the first, second, third, and fourth embodiments. The drive shaft 500 includes a hex-shaped rear shank portion 512 with an annular groove 514 configured to be coupled to a power tool and a front shaft circular or polygonal (e.g., hex-shaped) portion 516 extending axially forward of the rear shank portion 514 and configured to be non-rotatably coupled to one of the socket shafts 130, 230, 330, and 430. The front shaft portion 516 has a smaller diameter than a diameter of the rear shank portion 512 (measured either across the flats or across the corners) to form an internal shoulder 517 at the junction between the rear shank portion 512 and the front shaft portion 516. A ring 519 with a circular or polygonal (e.g., hex-shaped) opening 521 is received over the front shaft portion 516 and abuts the internal shoulder 517. The ring 519 has a larger outer diameter than both the rear shank portion 512 and the front shaft portion 516. The ring 519 acts as the rear outer shoulder in the first, second, third, and fourth embodiments described above.

In each of the above embodiments, the drive shaft may be composed of a relatively strong and durable paramagnetic material such as a mild carbon steel alloy, e.g., 6150 steel. The socket shaft may be composed of a strong and durable non-paramagnetic material, such as a stainless steel alloy, e.g., type 302 stainless steel. The sliding sleeve may be composed of a relatively strong and durable non-paramagnetic material such as a stainless steel alloy (e.g., type 302 stainless steel), an aluminum alloy (e.g., 2A12-T4), or a brass alloy (e.g., H65-Y2).

In use, in each of the above embodiments, the shank of the drive shaft is coupled to a bit holder or chuck of a rotary power tool. The sliding sleeve is retracted to its rearward position and a fastening bit is inserted into the socket. The working end of the fastening bit is magnetized by the magnet and is used to engage the head of a fastener (such as a screw). While the fastener is engaged by the fastening bit, the sliding sleeve is slid forward over the fastening bit and the fastener to its forward position. The power tool is activated to drive the drive shaft, which in turn drives the socket shaft, the fastening bit, and the fastener to drive the fastener into a workpiece. As the fastener is driven into the workpiece, the sliding sleeve retracts toward its rearward position until the fastener is seated in the workpiece. Thus, the sliding sleeve helps keep the fastener aligned axially with the axis X of the drive guide.

The designs described in the above embodiments have vastly improved durability and life as compared to the prior art DeWALT® DW2504 Compact Drive Guide (shown in FIGS. 16A-16D), Bosch® CC60491 Compact Drive Guide, and Irwin® 3555511C Compact Drive Guide. A set of six samples of each of the drive guides were tested using the following procedure. Each drive guide was received in the tool holder of a fully charged DEWALT DCF886 20V MAX* Impact Driver. A DEWALT PH2×1" FlexTorq™ screwdriving bit was coupled to the socket of the drive guide. The impact driver, drive guide, and screwdriving bit was used to drive #10×3" deck screws through two pieces of 2" pressure treated yellow pine to screw them together. The test proceeded until the drive guide was used to drive 2500 screws or until the drive guide failed by ceasing to function as intended. After completion of the test, each drive guide was inspected for damage. The results of the test are summarized in the following table.

| | DeWALT DW2504 | | Bosch CC60491 | | Irwin 3555511C | | Present Invention | |
|---|---|---|---|---|---|---|---|---|
| Sample | Screws Driven | Condition | Screws Driven | Condition | Screws Driven | Condition | Screws Driven | Condition |
| 1 | 2500 | Good | 2500 | Good | 1000 | Good | 2500 | Good |
| 2 | 2500 | Fail-poor bit retention | 456 | Fail-sleeve stuck | 1000 | Good | 2500 | Good |
| 3 | 1000 | Good | 2500 | Good | 1000 | Good | 2500 | Good |
| 4 | 1000 | Fail-sleeve stuck | 445 | Fail-sleeve stuck | 2500 | Good | 2500 | Good |
| 5 | 1000 | Fail-poor bit retention | 1000 | Good | 1991 | Fail-sleeve stuck | 2500 | Good |
| 6 | 1480 | Fail-poor bit retention | 158 | Fail-sleeve stuck | 2373 | Fail-sleeve stuck | 2500 | Good |

As shown in the above table, in the three prior art designs of drive guides, approximately 50% of the drive guides failed with significantly reduced functionality before driving 2500 screws. In contrast, in the drive guides of the present invention, 100% of the drive guides survived 2500 cycles in good condition without significantly diminished functionality. Thus, the designs of the present invention provide a significant performance improvement over the prior art designs.

Numerous modifications may be made to the exemplary implementations described above. These and other implementations are within the scope of the following claims.

What is claimed is:

1. A drive guide for driving fastening bits comprising:

a drive shaft extending along an axis, the drive shaft having a rear shank portion configured to be coupled to a power tool and a front shaft portion extending axially forward of the rear shank portion;

a socket shaft extending along the axis, the socket shaft having a rear end with a coupling that non-rotationally attaches the rear end to the front shaft portion of the drive shaft and a front end having a socket open to the front end, the socket configured to receive a fastening bit;

a magnet received in the socket, the magnet configured to magnetize a fastening bit received in the socket;

a generally cylindrical sliding sleeve received over the socket shaft and slidable along the axis between a rear position in which a front end of the sliding sleeve is aligned with or is axially rearward of the front end of the socket shaft and a forward position in which the front end of the sliding sleeve is axially forward of the front end of the socket shaft, the sliding sleeve having a first internal diameter and a first external diameter;

an internal rear stop integrally formed inside a rear end of the sliding sleeve, the internal rear stop having a second internal diameter that is less than the first internal diameter wherein the internal rear stop is formed by swaging the rear end so that the rear end has a second external diameter that is less than the first external diameter;

an external rear stop on one of the drive shaft and the socket shaft, the external rear stop positioned to abut against the internal rear stop of the sliding sleeve when the sliding sleeve is in the rear position; and an external front shoulder integrally formed on the front end of the socket shaft, the external front shoulder configured to abut against the internal rear stop when the sliding sleeve is in the forward position to prevent removal of the sliding sleeve from the socket shaft in the axial forward direction.

2. The drive guide of claim 1, wherein the front socket comprises a front hex portion for receiving a hex shaped fastening bit and a rear counterbore that receives the magnet.

3. The drive guide of claim 1, wherein the rear stop comprises a removable clip.

4. The drive guide of claim 1, wherein the external rear stop comprises an external rear shoulder integrally formed on one of the drive shaft and the socket shaft.

5. The drive guide of claim 1, further comprising an O-ring disposed on the socket shaft to frictionally resist axial movement of the sliding sleeve relative to the socket shaft.

6. The drive guide of claim 5, wherein the O-ring is disposed on the front shoulder.

7. The drive guide of claim 1, wherein the drive shaft is formed of a paramagnetic material and the socket shaft and sleeve each are formed of non-paramagnetic metal materials.

8. The drive guide of claim 7, wherein the drive shaft is composed of a carbon steel material, the socket shaft is composed of a stainless steel material, and the sliding sleeve is composed of one of a brass material, an aluminum material, and a stainless steel material.

9. The drive guide of claim 1, further comprising an air gap behind the magnet.

10. The drive guide of claim 9, wherein the air gap is cylindrical such that the magnet does not abut a rear wall of the socket.

11. A drive guide for driving fastening bits comprising:

a drive shaft extending along an axis, the drive shaft having a rear shank portion configured to be coupled to a power tool and a front shaft portion extending axially forward of the rear shank portion;

a socket shaft extending along the axis, the socket shaft having a rear end with a coupling that non-rotationally attaches the rear end to the front shaft portion of the drive shaft and a front end having a socket open to the front end, the socket configured to receive a fastening bit;

a magnet received in the socket with an air gap behind the magnet, the magnet configured to magnetize a fastening bit received in the socket;

a generally cylindrical sliding sleeve received over the socket shaft and slidable along the axis between a rear position in which a front end of the sliding sleeve is aligned with or is axially rearward of the front end of the socket shaft and a forward position in which the front end of the sliding sleeve is axially forward of the front end of the socket shaft, the sliding sleeve having a first internal diameter and a first external diameter;

an internal shoulder integrally formed inside a rear end of the sliding sleeve, the internal shoulder having a second internal diameter that is less than the first internal diameter wherein the internal rear stop is formed by swaging the rear end so that the rear end has a second external diameter that is less than the first external diameter;

an external rear stop on one of the drive shaft and the socket shaft, the rear stop positioned to abut against the rear end of the sliding sleeve when the sliding sleeve is in the rear position;

an external front shoulder integrally formed on the front end of the socket shaft, the front shoulder configured to abut against the internal shoulder when the sliding sleeve is in the forward position to prevent removal of the sliding sleeve from the socket shaft in the axial forward direction; and an O-ring disposed on the socket shaft to frictionally resist axial movement of the sliding sleeve relative to the socket shaft, wherein the drive shaft is composed of a paramagnetic material and the socket shaft and the sliding sleeve are each composed of a non-paramagnetic material.

12. The drive guide of claim 11, wherein the drive shaft is composed of a carbon steel material, the socket shaft is composed of a stainless steel material, and the sliding sleeve is composed of one of a brass material, an aluminum material, and a stainless steel material.

* * * * *